US008876936B2

(12) United States Patent
Kim et al.

(10) Patent No.: US 8,876,936 B2
(45) Date of Patent: Nov. 4, 2014

(54) ENGINE VALVE SEAT AND MANUFACTURING METHOD THEREOF

(75) Inventors: Ki Bum Kim, Seoul (KR); Eui Jun Kim, Gyeonggi-do (KR); Seong Jin Kim, Gyeonggi-do (KR); Sung Kweon Jang, Seoul (KR); Ki Jung Kim, Gyeonggi-do (KR); Shin Gyu Kim, Incheon (KR); Jong Kwan Park, Daegu (KR); Sung Tae Choi, Daegu (KR)

(73) Assignees: Hyundai Motor Company, Seoul (KR); Kia Motors Corporation, Seoul (KR); Korea Sintered Metal Co., Ltd., Daegu (KR)

( * ) Notice: Subject to any disclaimer, the term of this patent is extended or adjusted under 35 U.S.C. 154(b) by 309 days.

(21) Appl. No.: 13/323,343

(22) Filed: Dec. 12, 2011

(65) Prior Publication Data

US 2013/0068986 A1 Mar. 21, 2013

(30) Foreign Application Priority Data

Sep. 19, 2011 (KR) ..... 10-2011-0094014

(51) Int. Cl.

| | |
|---|---|
| ***C22C 38/04*** | (2006.01) |
| ***B22F 3/12*** | (2006.01) |
| ***C22C 27/04*** | (2006.01) |
| ***C22C 38/44*** | (2006.01) |
| ***C22C 38/00*** | (2006.01) |
| ***B22F 5/10*** | (2006.01) |
| ***C22C 38/52*** | (2006.01) |
| ***C22C 19/07*** | (2006.01) |
| ***C22C 33/02*** | (2006.01) |
| ***C22C 27/06*** | (2006.01) |
| ***B22F 1/00*** | (2006.01) |

(52) U.S. Cl.

CPC ... *B22F 1/00* (2013.01); *B22F 3/12* (2013.01); *C22C 27/04* (2013.01); *C22C 38/44* (2013.01); *C22C 38/002* (2013.01); *B22F 5/106* (2013.01); *C22C 38/52* (2013.01); *C22C 19/07* (2013.01); *C22C 33/0285* (2013.01); *C22C 38/04* (2013.01); *C22C 27/06* (2013.01)

USPC ..... 75/246; 75/243; 419/39; 419/57

(58) Field of Classification Search

CPC ..... B22F 5/106; B22F 3/01; C22C 33/0207; F01L 3/02

USPC ..... 251/359, 368

See application file for complete search history.

(56) References Cited

U.S. PATENT DOCUMENTS

| | | | | |
|---|---|---|---|---|
| 5,498,483 | A * | 3/1996 | Ito et al. | 428/552 |
| 5,870,989 | A * | 2/1999 | Takahashi et al. | 123/188.3 |
| 6,712,871 | B2 * | 3/2004 | Oh | 75/239 |
| 8,277,533 | B2 * | 10/2012 | Farthing et al. | 75/252 |

FOREIGN PATENT DOCUMENTS

| | | |
|---|---|---|
| JP | 07-109539 A | 4/1995 |

* cited by examiner

*Primary Examiner* — George Wyszomierski
*Assistant Examiner* — Ngoclan T Mai
(74) *Attorney, Agent, or Firm* — Edwards Wildman Palmer LLP; Peter F. Corless

(57) ABSTRACT

Disclosed herein is an engine valve seat, including: iron (Fe) as a main component; about 0.6~1.2 wt % of carbon (C); about 1.0~3.0 wt % of nickel (Ni); about 8.0~11.0 wt % of cobalt (Co); about 3.0~6.0 wt % of chromium (Cr); about 4.0~7.0 wt % of molybdenum (Mo); about 0.5~2.5 wt % of tungsten (W); about 1.0~3.0 wt % of manganese (Mn); about 0.2~1.0 wt % of calcium (Ca); and other inevitable impurities.

7 Claims, 2 Drawing Sheets

PRIOR ART

ENGINE VALVE SEAT AND MANUFACTURING METHOD THEREOF

CROSS-REFERENCE TO RELATED APPLICATION

This application claims under 35 U.S.C. §119(a) the benefit of Korean Patent Application No. 10-2011-0094014 filed on Sep. 19, 2011, the entire contents of which are incorporated herein by reference.

BACKGROUND OF THE INVENTION

1. Technical Field

The present invention relates to an engine valve seat having excellent wear resistance, particularly an engine valve seat in which an iron-based powder alloyed with chromium (Cr) and molybdenum (Mo) is used as a matrix, and a method of manufacturing the same.

2. Description of the Related Art

FIG. 1 is a sectional view showing a conventional engine valve seat. Generally, a valve seat 14 of an engine 10 is fitted in a cylinder head 12 to maintain the airtightness between an intake valve or an exhaust valve 16 and the cylinder head 12 when the valve 16 opens and closes. The valve seat 14, thus, serves to increase the thermal efficiency of a combustion chamber.

Because the valve seat 14 repeatedly comes into contact with the valve 16 and is exposed to continuous high temperatures, it typically requires higher wear resistance, impact resistance, heat resistance and the like than other parts.

Methods for manufacturing the valve seat 14 include an infiltration method, a hard particle addition method, an alloy composition control method and the like. In the past, gasoline containing lead ("leaded gasoline") has been used as fuel. However, because the use of leaded gasoline causes environmental pollution, the use of unleaded gasoline is now required. Therefore, the valve seat 14 must have high performance, much like the high performance of engines, and must also generate high power and employ gasoline direction injection (GDI).

In engines using gas fuel such as liquefied petroleum gas (LPG), compressed natural gas (CNG) or the like, the valve seat 14 tends to be easily worn. In particular, use of such fuel generally does not provide the solid lubricity between the valve 16 and the valve seat 14 which typically results from the combustion products occurring when liquid fuel (gasoline, diesel oil) is used Thus, without such lubrication, metal contact (K) between the valve 16 and the valve seat 14 easily occurs, resulting in wear on the valve seat 14. Under such circumstances, the wear resistance of the valve seat 14 for gas fuel engines must be further improved.

In an attempt to improve the wear resistance of the valve seat 14, a method of dispersing Fe—Cr or Fe—Mo based hard particles or carbide-based hard particles in the matrix of the valve seat 14 has been used. However, this method is problematic in that, when the amount of hard particles dispersed in the matrix increases, the aggressiveness of the hard particles against a target (that is, a valve) increases, and thus the valve is more easily worn.

It is to be understood that the foregoing description is provided to merely aid the understanding of the present invention, and does not mean that the present invention falls under the purview of the related art which was already known to those skilled in the art.

SUMMARY OF THE INVENTION

Accordingly, the present invention has been devised to solve the above-mentioned problems associated with the prior art. The present invention provides an engine valve seat having high wear resistance. In particular, the present invention provides an iron-based sintered alloy having high wear resistance and which can be used in forming a valve seat of an engine. The thus formed valve seat can, to a very high degree, prevent a valve from being worn and can improve the wear resistance thereof.

In order to accomplish the above object, an aspect of the present invention provides an engine valve seat, including: iron (Fe) as a main component; and one or more further materials selected from carbon (C), nickel (Ni), cobalt (Co), chromium (Cr), molybdenum (Mo), tungsten (W), manganese (Mn), calcium (Ca). According to various embodiments, an engine valve seat of the present invention includes iron (Fe) as a main component; about 0.6~1.2 wt % of carbon (C); about 1.0~3.0 wt % of nickel (Ni); about 8.0~11.0 wt % of cobalt (Co); about 3.0~6.0 wt % of chromium (Cr); about 4.0~7.0 wt % of molybdenum (Mo); about 0.5~2.5 wt % of tungsten (W); about 1.0~3.0 wt % of manganese (Mn); about 0.2~1.0 wt % of calcium (Ca), wherein wt % are based on the total weight of the composition; and other impurities which may be inevitable. It is noted that the term "main component" when referring to the content of iron (Fe) means amounts greater than 50 wt %, for example, at least about 60 wt %, at least about 65 wt %, at least about 70 wt %, at least about 75 wt %, etc. For example, when totaling the wt % of all other components, iron (Fe) will account for the remainder of the composition (minus any small amounts of impurities which may or may not be present).

According to various embodiments, the engine valve seat may include a matrix manufactured by mixing alloy powders (e.g. chromium (Cr), molybdenum (Mo), manganese (Mn)) and iron (Fe), with metal powders (e.g. carbon (C), nickel (Ni) and cobalt (Co)). According to various embodiments, the engine valve seat may include a matrix manufactured by mixing alloy powders including about 0.8~1.2 wt % of chromium (Cr), about 0.4~0.6 wt % of molybdenum (Mo), about 0.5~0.9 wt % of manganese (Mn), about 1.0~1.4 wt % of carbon (C) and a balance of iron (Fe), with metal powders including about 0.1~0.3 wt % of carbon (C), about 1.0~3.0 wt % of nickel (Ni) and about 1.0~3.0 wt % of cobalt (Co), wherein wt % are based on the total weight of the composition.

According to an exemplary embodiment the engine valve seat may be manufactured by mixing hard particles with the matrix. Examples of hard particles include, for example, 60 wt % cobalt (Co)-30 wt % molybdenum (Mo)-8 wt % chromium (Cr) alloy powder, iron (Fe)-40 wt % chromium (Cr)-20 wt % tungsten (W)-10 wt % cobalt (Co) alloy powder, and iron (Fe)-60 wt % molybdenum (Mo) alloy powder, which are hard particles, wherein the wt % are based on the total weight of each of the hard particle formulations, and wherein impurities account for any remaining balance. According to various embodiments, any combination of one or more of these hard particles could be mixed with the matrix. The hard particles can be suitably formed using any conventional methods, and can be provided with a suitable size and shape that will provide the desired characteristics. For example, in one embodiment, the 60 wt % cobalt (Co)-30 wt % molybdenum (Mo)-8 wt % chromium (Cr) alloy powder may be prepared by gas injection, and may have a particle size of about 60 mesh or less.

Another aspect of the present invention provides a method of manufacturing an engine valve seat, comprising the steps of: mixing metal powders such that the engine valve seat includes iron (Fe) as a main component, about 0.6~1.2 wt % of carbon (C), about 1.0~3.0 wt % of nickel (Ni), about 8.0~11.0 wt % of cobalt (Co), about 3.0~6.0 wt % of chromium (Cr), about 4.0~7.0 wt % of molybdenum (Mo), about 0.5~2.5 wt % of tungsten (W), about 1.0-3.0 wt % of manganese (Mn), about 0.2~1.0 wt % of calcium (Ca), and optionally other inevitable impurities; pressing the metal powder mixture to form a compact structure having a suitable density (e.g. a density of about 6.85 g/cc or more); and sintering the compact structure under a suitable nitrogen atmosphere (e.g. nitrogen atmosphere of about 1130~1180).

In the step of mixing of the metal powders, alloy powders including about 0.8~1.2 wt % of chromium (Cr), about 0.4~0.6 wt % of molybdenum (Mo), about 0.5~0.9 wt % of manganese (Mn), about 1.0~1.4 wt % of carbon (C) and a balance of iron (Fe) may be mixed with metal powders including about 0.1~0.3 wt % of carbon (C), about 1.0~3.0 wt % of nickel (Ni) and about 1.0~3.0 wt % of cobalt (Co) to form the matrix, and then hard particles may be mixed with the matrix.

The hard particles may include, for example, 60 wt % cobalt (Co)-30 wt % molybdenum (Mo)-8 wt % chromium (Cr) alloy powder, iron (Fe)-40 wt % chromium (Cr)-20 wt % tungsten (W)-10 wt % cobalt (Co) alloy powder and iron (Fe)-60 wt % molybdenum (Mo) alloy powder.

According to various embodiments, the 60 wt % cobalt (Co)-30 wt % molybdenum (Mo)-8 wt % chromium (Cr) alloy powder may be prepared by gas injection, and may have a particle size of about 60 mesh or less.

In forming of the compact structure, the compact structure having a density of about 6.85 g/cc or more may be formed by pressing the metal powder mixture at a pressure of about 7~9 ton/cm$^2$ at room temperature.

After sintering of the compact structure, infiltration or heat-treatment may not be required and, thus, may be omitted.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, reference will now be made in detail to various embodiments of the present invention, examples of which are illustrated in the accompanying drawings and described below. While the invention will be described in conjunction with exemplary embodiments, it will be understood that present description is not intended to limit the invention to those exemplary embodiments. On the contrary, the invention is intended to cover not only the exemplary embodiments, but also various alternatives, modifications, equivalents and other embodiments, which may be included within the spirit and scope of the invention as defined by the appended claims.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Figure 1:
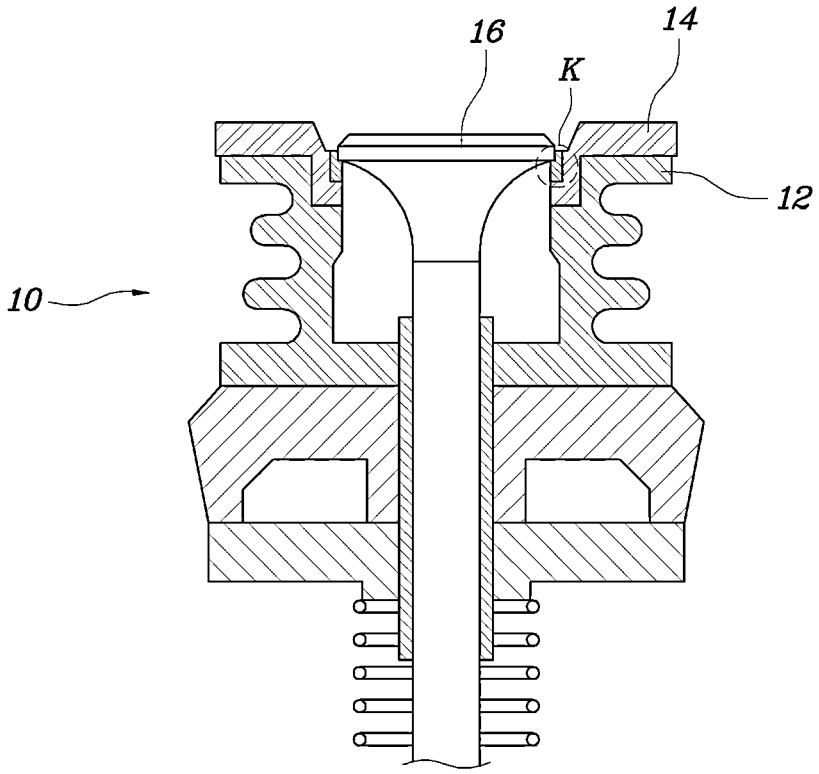
FIG. 1 is a sectional view showing a conventional engine valve seat.
Figure 2:
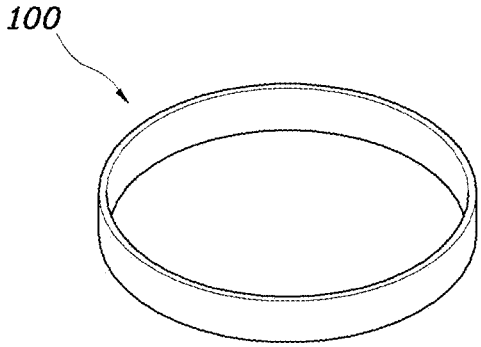
FIG. 2 is a perspective view showing an engine valve seat according to an embodiment of the present invention.
Figure 3:
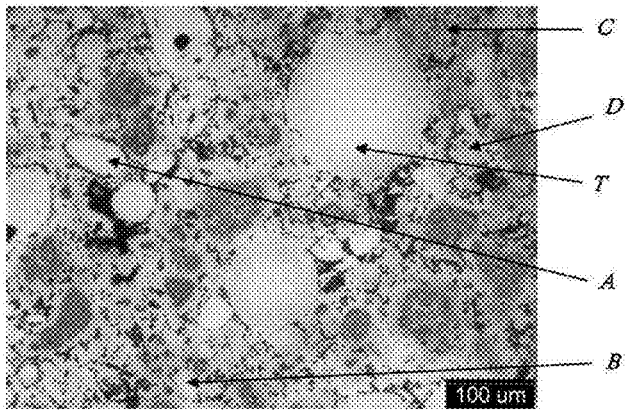
FIG. 3 is a photograph showing the microscopic structure of the engine valve seat of FIG. 2.

FIG. 2 is a perspective view showing an engine valve seat according to an embodiment of the present invention, and FIG. 3 is a photograph showing the microscopic structure of the engine valve seat of FIG. 2.

In this embodiment, the engine valve seat includes: iron (Fe) as a main component; about 0.6~1.2 wt % of carbon (C); about 1.0~3.0 wt % of nickel (Ni); about 8.0~11.0 wt % of cobalt (Co); about 3.0~6.0 wt % of chromium (Cr); about 4.0~7.0 wt % of molybdenum (Mo); about 0.5~2.5 wt % of tungsten (W); about 1.0~3.0 wt % of manganese (Mn); about 0.2~1.0 wt % of calcium (Ca); and other inevitable impurities.

In various embodiments, the engine valve seat may include a matrix manufactured by mixing alloy powders and iron with metal powders. In particular, the matrix may be manufactured by mixing alloy particles including about 0.8~1.2 wt % of chromium (Cr), about 0.4~0.6 wt % of molybdenum (Mo), about 0.5~0.9 wt % of manganese (Mn), about 1.0~1.4 wt % of carbon (C) and a balance of iron (Fe) with metal powders including about 0.1~0.3 wt % of carbon (C), about 1.0~3.0 wt % of nickel (Ni) and about 1.0~3.0 wt % of cobalt (Co).

In certain aspects, the engine valve seat may be manufactured by further mixing hard particles with the matrix. In various embodiments, the hard particles can include, for example, 60 wt % cobalt (Co)-30 wt % molybdenum (Mo)-8 wt % chromium (Cr) alloy powder, iron (Fe)-40 wt % chromium (Cr)-20 wt % tungsten (W)-10 wt % cobalt (Co) alloy powder and iron (Fe)-60 wt % molybdenum (Mo) alloy powder. In some embodiments, the 60 wt % cobalt (Co)-30 wt % molybdenum (Mo)-8 wt % chromium (Cr) alloy powder may be prepared by a suitable method such as gas injection, and may have a suitable particle size of, for example, about 60 mesh or less.

According to aspects of the invention, the shape of hard particles of a valve seat is important because it can decrease the aggressiveness of the valve seat against a target (e.g. valve). Therefore, for example, the 60 wt % Co-30 wt % Mo-8 wt % Cr hard particles, which may be added in large amounts in order to prevent the hard particles from being separated from the matrix of the valve seat, can be suitably prepared (e.g. by gas injection) such that the shape of the cobalt (Co)-based hard particles becomes spherical. Such a spherical shape can beneficially decrease the aggressiveness of the valve seat against a target.

In accordance with various embodiments, carbon (C) can be obtained in the form of alloy powder of Fe—Cr—Mo—Mn—C and natural graphite powder, and nickel (Ni) can be obtained in the form of pure nickel (Ni) powder. Further, cobalt (Co) can be obtained in the form of pure cobalt (Co) powder, alloy powder of Fe—Cr—W—Co, or alloy powder of Co—Mo—Cr prepared by gas injection in order to make the shape of the cobalt (Co)-based hard particles spherical. Further, chromium (Cr) can be obtained in the form of alloy powder of Fe—Cr—W—Co or alloy powder of Co—Mo—Cr prepared by gas injection. Further, molybdenum (Mo) can be obtained in the form of ferromolybdenum (Ferro Mo), manganese (Mn) can be obtained in the form of MnS, and calcium (Ca) can be obtained in the form of $CaF_2$.

According to embodiments of the invention, the components and the composition ratio of the components constituting the valve seat can be selected so as to provide the following advantages. First, carbon (C) can be solid-dispersed in a matrix to reinforce the matrix, and can be formed into carbide together with chromium (Cr), molybdenum (Mo) and the like to improve wear resistance. Carbon (C) is advantageously added in an amount of about 0.6~1.2 wt % based on the total amount of the composition. When the amount of carbon (C) is less than 0.6 wt %, the desired improvement in wear resistance is not obtained. Further, when the amount of carbon (C) is more than 1.2 wt %, cementite is formed in the matrix, and a liquid phase is formed during sintering, thus deteriorating the stability of the matrix.

Nickel (Ni) is solid-dispersed in the matrix to improve strength and heat resistance. Nickel (Ni) is advantageously added in an amount of about 1.0~3.0 wt % based on the total amount of the composition. When the amount of nickel (Ni) is less than 1.0 wt %, heat resistance is not adequately improved. Further, when the amount of nickel (Ni) is more than 3 wt %, an excessive amount of austenite locally remains, thus deteriorating wear resistance.

Cobalt (Co) is solid-dispersed in the matrix in the form of hard particles to improve strength and heat resistance. Further, when cobalt (Co) is included in the hard particles in the form of an intermetallic compound, an increase of the contact force between the matrix and the hard particles is provided to thereby prevent the abrasion of the valve seat attributable to separation of the hard particles.

Chromium (Cr) reacts with carbon to form carbide to improve wear resistance, and is solid-dispersed in the matrix to improve heat resistance.

Molybdenum (Mo) is solid-dispersed in the matrix to improve heat resistance and hardenability, and is added in the form of Fe—Mo to form double carbide or an intermetallic compound to improve wear resistance. However, when molybdenum (Mo) is excessively added, the strength of the valve seat is deteriorated and it attacks a target (e.g. valve) to cause wear on the valve. Therefore, the amount of molybdenum (Mo) is advantageously limited to the above specified range.

The method of manufacturing an engine valve seat according to an embodiment of the present invention includes the steps of: mixing metal powders such that the engine valve seat includes iron (Fe) as a main component, about 0.6~1.2 wt % of carbon (C), about 1.0~3.0 wt % of nickel (Ni), about 8.0~11.0 wt % of cobalt (Co), about 3.0~6.0 wt % of chromium (Cr), about 4.0~7.0 wt % of molybdenum (Mo), about 0.5~2.5 wt % of tungsten (W), about 1.0~3.0 wt % of manganese (Mn), about 0.2~1.0 wt % of calcium (Ca), and other inevitable impurities; pressing the metal powder mixture to form a compact having a suitable density (e.g. a density of about 6.85 g/cc or more); and sintering the compact under a suitable nitrogen atmosphere (e.g. a nitrogen atmosphere of about 1130~1180).

According to this embodiment, in the step of mixing the metal powders, alloy powders including about 0.8~1.2 wt % of chromium (Cr), about 0.4~0.6 wt % of molybdenum (Mo), about 0.5~0.9 wt % of manganese (Mn), about 1.0~1.4 wt % of carbon (C) and a balance of iron (Fe) may be mixed with metal powders including about 0.1~0.3 wt % of carbon (C), about 1.0~3.0 wt % of nickel (Ni) and about 1.0~3.0 wt % of cobalt (Co) to form the matrix. Hard particles may further be mixed with the matrix.

Examples of the hard particles may include 60 wt % cobalt (Co)-30 wt % molybdenum (Mo)-8 wt % chromium (Cr) alloy powder, iron (Fe)-40 wt % chromium (Cr)-20 wt % tungsten (W)-10 wt % cobalt (Co) alloy powder and iron (Fe)-60 wt % molybdenum (Mo) alloy powder. According to some embodiments, the 60 wt % cobalt (Co)-30 wt % molybdenum (Mo)-8 wt % chromium (Cr) alloy powder may be prepared by gas injection, and may have a particle size of about 60 mesh or less.

Further, in the step of forming the compact structure, the compact structure may be formed having a density of about 6.85 g/cc or more by pressing the metal powder mixture at a pressure of 7~9 ton/cm$^2$ at room temperature. Further, after the step of sintering the compact, infiltration or heat-treatment may be omitted.

Hereinafter, the process of manufacturing an engine valve seat according to the present invention will be briefly described as follows.

First, the raw powders (iron (Fe), carbon (C), nickel (Ni), cobalt (Co), chromium (Cr), molybdenum (Mo), tungsten (W), manganese (Mn), calcium (Ca), etc.) are mixed with each other to obtain the final composition mentioned above. Subsequently, the powder mixture is pressed at a suitable pressure (e.g. a pressure of about 7.9 ton/cm$^2$ at room temperature) to form a compact structure. In this case, the compact structure may be formed such that the density of resulting valve seat is about 6.85 g/cc or more, and thus, in some embodiments high-hardness particles, middle-hardness particles and/or low-hardness particles can be properly dispersed in the matrix to provide the valve seat with the desired density.

Finally, the compact structure is sintered to form the valve seat. For example, sintering can be carried out under a nitrogen atmosphere of about 1130~1180 for about 30 minutes~1.5 hours, thus forming a valve seat 100. In accordance with the present invention, after sintering has been carried out, infiltration or heat-treatment is not required and can be omitted, thus reducing the manufacturing cost of a valve seat.

As shown in FIG. 3, the valve seat 100 thus manufactured is provided with hard particles having a shape of a spherical intermetallic compound dispersed in the matrix, which is not subjected to heat-treatment. According to embodiments of the present invention, the bonding force between the matrix and the hard particles is greatly increased by the diffusion of cobalt (Co) which can be included in the hard particles, so that the separation of hard particles can be prevented, thereby decreasing the total abrasion loss of the valve seat. In FIG. 3, matrix 1 (C) is a pearlite structure, matrix 2 (D) is a high alloy region, hard particle 1 (T) is a Co—Mo—Cr structure, hard particle 2 (A) is a Cr—W—Co structure, and hard particle 3 (B) is a Fe—Mo structure.

Hereinafter, in order to measure the abrasion loss of the engine valve seat 100 made of sintered alloy, powders were mixed with each other according to the content and composition given in Table 1 below, and then the powder mixture was pressed at a pressure of 8 ton/cm$^2$ to form a compact structure in the shape of an engine valve seat, and then the compact structure was sintered at 1150° C. for 40 minutes. Then, the sintered compact structure was processed in the shape of an engine valve seat, followed by a barrel process to manufacture engine valve seats according to the Examples. In the Comparative Examples, engine valve seats were manufactured by copper-infiltrating the compact obtained through the conventional process and then heat-treating the infiltrated compact or by a 2P2S (2 press 2 sintering) process.

TABLE 1

| Class. | Matrix composition (wt %) C | Ni | Cr | Co | Mo | V | Fe | Hard particles kind | content (wt %) | Heat treatment | Manufacturing method |
|---|---|---|---|---|---|---|---|---|---|---|---|
| Ex. 1 | 1.0 | 2.0 | 1.0 | — | 0.3 | — | balance | A + B + T1 | 25 | X | 1P1S |
| Ex. 2 | 1.0 | 2.0 | 1.0 | — | 0.3 | — | balance | A + B + T2 | 25 | ○ | 1P1S |
| Ex. 3 | 1.0 | 2.0 | 1.0 | — | 0.3 | — | balance | A + B + T3 | 25 | ○ | 1P1S |
| Ex. 4 | 1.0 | 2.0 | 1.0 | 2.0 | 0.3 | — | balance | A + B + T1 | 25 | ○ | 1P1S |
| Ex. 5 | 1.0 | 2.0 | 1.0 | 2.0 | 0.3 | — | balance | A + B + T2 | 25 | ○ | warm forming |
| Ex. 6 | 1.0 | 2.0 | 1.0 | 2.0 | 0.3 | — | balance | A + B + T3 | 25 | X | IPIS |
| Comp. Ex. 1 | 1.2 | 2.0 | — | 6.5 | 1.5 | 1.0 | balance | A | 25 | ○ | copper infiltration |
| Comp. Ex. 2 | 0.8 | 1.5 | — | 6.5 | 1.5 | — | balance | T1 | 25 | X | 2P2S |
| Comp. Ex. 3 | 1.0 | 5.5 | 3.0 | — | — | — | balance | T1 | 25 | X | 2P2S |

Here, 1P1S is referred to as "1 Press 1 Sintering", and 2P2S is referred to as "2 Press 2 Sintering". Further, hard particles are as follows:

A: Fe—40 wt % Cr—20 wt % W—10 wt % Co

B: Fe—60 wt % Mo

T1: 60 wt % Co—30 wt % Mo—8 wt % Cr (prepared by water injection, having a particle size of 200 mesh or less)

T2: 60 wt % Co—30 wt % Mo—8 wt % Cr (prepared by water injection, having a particle size of 100 mesh or less)

T3: 60 wt % Co—30 wt % Mo—8 wt % Cr (prepared by gas injection, having a particle size of 60 mesh or less)

The abrasion losses of the valve seats of the Examples and Comparative Examples were measured using an abrasion tester having a shape similar to that of a real engine, and the results thereof (test method: a rotation speed of 1500 rpm, a valve seat temperature of 400° C., a test time of 15 hours) are given in Table 2 below.

TABLE 2

| Class. | Density ($g/cm^3$) | Hardness (Hv) | Pressing load ($kg_f$) | Abrasion loss (μm) valve seat | valve |
|---|---|---|---|---|---|
| Ex. 1 | 7.09 | 284 | 207 | 95 | 10 |
| Ex. 2 | 7.02 | 332 | 108 | 70 | 15 |
| Ex. 3 | 7.01 | 326 | 105 | 62 | 8 |
| Ex. 4 | 7.14 | 322 | 142 | 65 | 9 |
| Ex. 5 | 7.08 | 331 | 134 | 42 | 12 |
| Ex. 6 | 7.04 | 295 | 120 | 31 | 7 |
| Comp. Ex. 1 | 7.81 | 383 | 314 | 250 | 18 |
| Comp. Ex. 2 | 7.20 | 253 | 165 | 130 | 27 |
| Comp. Ex. 3 | 7.26 | 267 | 70 | 60 | 15 |

As given in Table 2 above, it can be ascertained that the abrasion losses of the engine valve seats of the Examples were reduced compared to those of the engine valve seats of Comparative Examples. Particularly, in the durability test, the engine valve seat of Example 6 exhibited good durability even though it was not heat-treated.

As described above, the engine valve seat according to the present invention is advantageous in that it exhibits excellent wear resistance even when used in gas fuel engines operating under severe combustion conditions, and in that it has excellent wear resistance even though filtration or heat-treatment is not additionally conducted. Further, the engine valve seat according to the present invention is advantageous in that it can prevent a target (valve) from being worn to the highest degree, and in that its wear resistance can be improved.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

The contents of all references (including literature references, issued patents, published patent applications, and co-pending patent applications) cited throughout this application are hereby expressly incorporated herein in their entireties by reference.

What is claimed is:

1. An engine valve seat, comprising:

iron (Fe) as a main component;

about 0.6~1.2 wt % of carbon (C);

about 1.0~3.0 wt % of nickel (Ni);

about 8.0~11.0 wt % of cobalt (Co);

about 3.0~6.0 wt % of chromium (Cr);

about 4.0~7.0 wt % of molybdenum (Mo);

about 0.5~2.5 wt % of tungsten (W);

about 1.0~3.0 wt % of manganese (Mn);

about 0.2~1.0 wt % of calcium (Ca); and one or more impurities, wherein the engine valve seat further comprises one or more hard particles of 60 wt % cobalt (Co)-30 wt % molybdenum(Mo)-8 wt % chromium(Cr) alloy powder prepared by gas injection, and having a particle size of about 60 mesh or less.

2. The engine valve seat according to claim 1, wherein the engine valve seat comprises a matrix formed by mixing alloy powders including 0.8~1.2 wt % of chromium (Cr), 0.4~0.6 wt % of molybdenum (Mo), 0.5~0.9 wt % of manganese (Mn), 1.0~1.4 wt % of carbon (C) and a balance of iron (Fe) with metal powders including 0.1~0.3 wt % of carbon (C), 1.0~3.0 wt % of nickel (Ni) and 1.0~3.0 wt % of cobalt (Co).

3. A method of manufacturing an engine valve seat, comprising the steps of:

mixing metal powders such that the engine valve seat includes iron (Fe) as a main component, about 0.6~1.2 wt % of carbon (C), about 1.0~3.0 wt % of nickel (Ni), about 8.0~11.0 wt % of cobalt (Co), about 3.0~6.0 wt % of chromium (Cr), about 4.0~7.0 wt % of molybdenum (Mo), about 0.5~2.5 wt % of tungsten (W), about 1.0~3.0 wt % of manganese (Mn), about 0.2~1.0 wt % of calcium (Ca), and one or more impurities;

pressing the metal powder mixture to form a compact structure having a density of about 6.85 g/cc or more; and sintering the compact structure under a nitrogen atmosphere of about 1130~1180° C., wherein, in the step of mixing of the metal powders, alloy powders including 0.8~1.2 wt % of chromium (Cr), 0.4~0.6 wt % of molybdenum (Mo), 0.5~0.9 wt % of manganese (Mn), 1.0~1.4 wt % of carbon (C) and a balance of iron (Fe) are mixed with metal powders including 0.1~0.3 wt % of carbon (C), 1.0~3.0 wt % of nickel (Ni) and 1.0~3.0 wt % of cobalt (Co) to form the matrix, and then hard particles are mixed with the matrix.

4. The method of manufacturing an engine valve seat according to claim 3, wherein the hard particles include one or more of 60 wt % cobalt (Co)-30 wt % molybdenum (Mo)-8 wt % chromium (Cr) alloy powder, iron (Fe)-40 wt % chromium (Cr)-20 wt % tungsten (W)-10 wt % cobalt (Co) alloy powder and iron (Fe)-60 wt % molybdenum (Mo) alloy powder.

5. The method of manufacturing an engine valve seat according to claim 4, wherein the 60 wt % cobalt (Co)-30 wt % molybdenum (Mo)-8 wt % chromium (Cr) alloy powder is prepared by gas injection, and has a particle size of about 60 mesh or less.

6. The method of manufacturing an engine valve seat according to claim 3, wherein, the compact structure having a density of about 6.85 g/cc or more is formed by pressing the metal powder mixture at a pressure of about 7~9 ton/cm2 at room temperature.

7. The method of manufacturing an engine valve seat according to claim 3, wherein infiltration or heat-treatment is omitted after the sintering of the compact structure.

* * * * *